US006484963B1

(12) United States Patent
Lohmann

(10) Patent No.: US 6,484,963 B1
(45) Date of Patent: Nov. 26, 2002

(54) WINDING FRAME

(75) Inventor: Ralf Lohmann, Schwalmtal (DE)

(73) Assignee: Volkmann GmbH (DE)

( * ) Notice: Subject to any disclaimer, the term of this patent is extended or adjusted under 35 U.S.C. 154(b) by 0 days.

(21) Appl. No.: 09/579,942

(22) Filed: May 26, 2000

(30) Foreign Application Priority Data

May 27, 1999 (DE) ..... 199 24 390

(51) Int. Cl.[7] ..... B65H 59/10
(52) U.S. Cl. ..... 242/486.2; 188/67
(58) Field of Search ..... 242/486.2, 486.4; 188/67

(56) References Cited

U.S. PATENT DOCUMENTS 4,305,264 A * 12/1981 Mim ..... 74/574
4,969,609 A * 11/1990 Scheuter ..... 242/534
5,542,505 A * 8/1996 Kempf ..... 188/77 W
5,823,300 A * 10/1998 Higuchi ..... 188/67

FOREIGN PATENT DOCUMENTS

DE 3809421 A1 10/1988
DE 9014282.9 3/1991
GB 2 204 334 A * 11/1988 ..... B65H/54/54

* cited by examiner

*Primary Examiner*—Donald P. Walsh
*Assistant Examiner*—Joseph Rodriguez
(74) *Attorney, Agent, or Firm*—R W Becker & Associates; R W Becker

(57) ABSTRACT

A winding frame is provided which is swingably mountable on a machine frame and operable to support a rotatably driveable winding core for the winding of a filament thereon. The winding frame includes a damping apparatus for opposing unscheduled swing movements of the winding frame during regular winding of a filament onto the winding core.

13 Claims, 3 Drawing Sheets

WINDING FRAME

BACKGROUND OF THE INVENTION

The present invention relates to a winding frame which is pivotably securable to a winding machine support for supporting a rotatably driveable winding core onto which a yarn is wound. The term "winding core" is to be understood as a proxy for the term "winding tube" and "winding package". The term "filament" encompasses the totality of yarn formed geometries such as, for example, spinning or two-for-one or twist yarns of various machine assemblies.

A winding frame of the type above referred to is disclosed, for example, in DE-PS 38 09 421 A1, and includes two opposed carry arms between which is rotatably supported a winding core onto which yarn is to be wound. The rotatative driving of the winding core is effected by a friction drive roller against which the winding core lies and which performs the function of a support roller. Another possibility for effecting the driving of the winding core is an individual motor securable on the winding frame which directly drives the winding core which itself is supported against a freely rotatable support roller. In conventional winding frames, the damping apparatus, which is operable to oppose unscheduled swing movements of the winding frame during regular winding of a winding core, comprises a guide rod pivotally mounted to the machine frame along which a guide is movable, the guide being movably secured to the winding frame by ball pins or ball studs and having a friction-or brake-jaw movably secured thereto which is biasable by a spring against the guide rod. In this manner, a swing movement free rotation of the winding core during winding thereon to is ensured. A damping apparatus such as this is—especially because of the movable connection of the braking element on the guide—relatively prone to disruptions and is, thus, not operationally reliable.

SUMMARY OF THE INVENTION

The present invention achieves the objective of providing a winding frame, having a damping apparatus, of relatively simple construction which is nonetheless operationally reliable.

To achieve this objective, the inventive damping apparatus includes a guide rod movably secured to the winding frame upon which can act at least one braking surface adjustably movable in a direction perpendicular to the axis of the guide rod, the guide rod extending through a housing pivotally mounted on the machine frame.

In accordance with the present invention, only two swing movement dispositions are needed, namely, the swingable positioning of the guide rod on the winding frame and, on the other hand, the swingable positioning—that is, the pivotable positioning—of the housing, which houses the braking surface, on the machine frame. In this manner, a high functioning reliability of the damping apparatus is ensured and this is so especially because the braking surface is adjustable only in the direction perpendicular to the axis of the guide rod.

The braking surface can be actuated by spring or pressurized air.

Further features of the invention are set forth in the description and claims hereto.

DETAILED DESCRIPTION OF THE PREFERRED EMBODIMENTS

Figure 1:
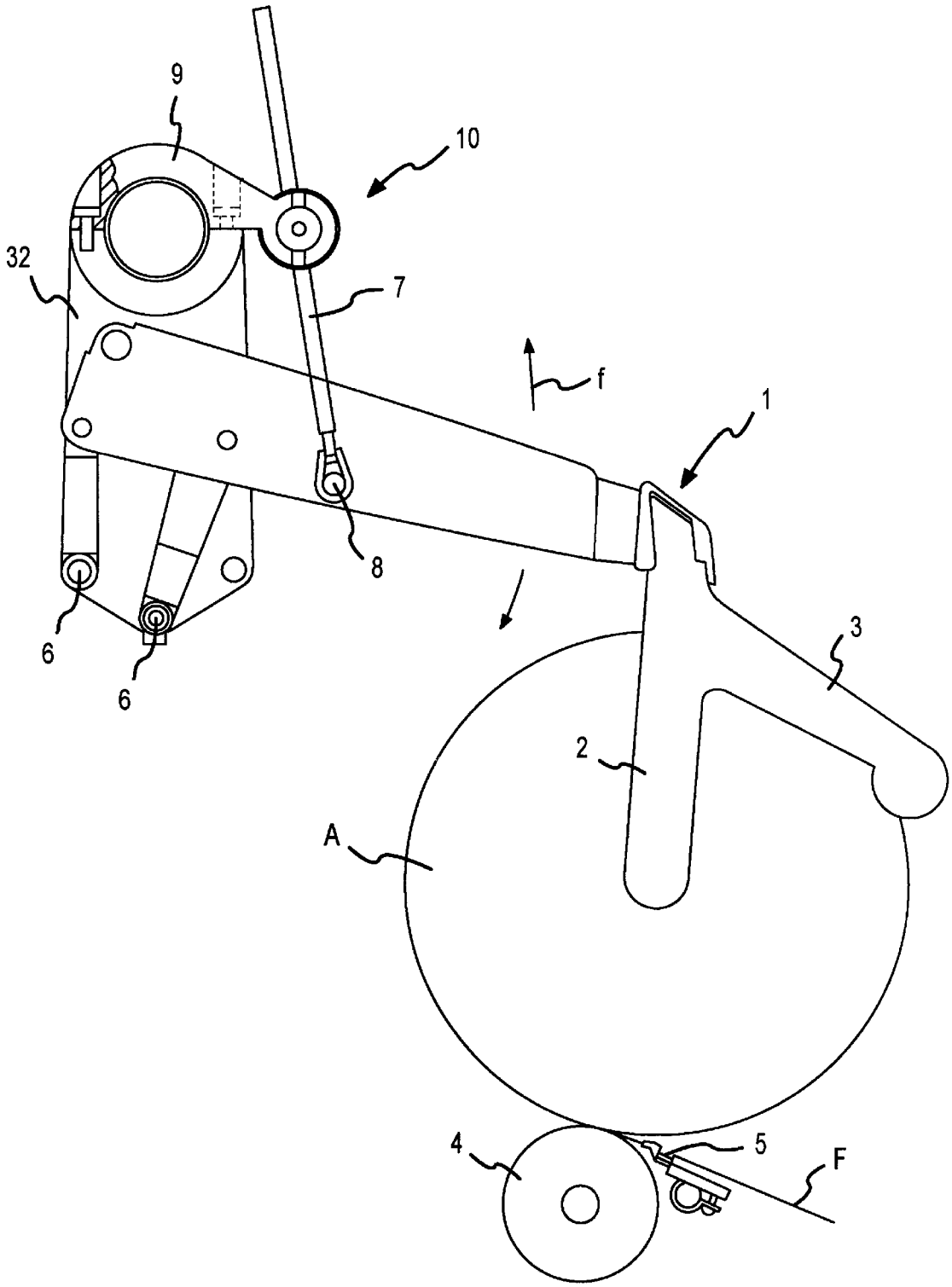
FIG. 1 is a schematic side view of the inventive winding frame in which a winding core driveable by a friction drive roller is disposed.

In accordance with FIG. 1, the winding frame 1 of the present invention, which may be configured, for example, as a four link winding frame, is mounted on a console 32 representing a machine frame for swinging movement on an axis 6 in the dual opposed directions f. The winding frame includes two opposed carry arms of which only one carry arm 2 is shown in FIG. 1 and on which a hand grip 3 can be provided for manual raising of the winding frame 1 in order to raise the winding core A off the friction drive roller 4 which drives it. FIG. 1 further depicts, in schematic form, a typical yarn changing guide 5 operable to guide a filament or yarn F onto the winding core A.

In the event that there is an individual motor direct drive of the winding core A, an individual motor (not shown) is disposed on one of the carry arms 2, whereby the friction drive roller 4 is configured as a freely rotating support roller.

A guide rod 7, which is preferably formed of metal, especially chromium-nickel-steel, has one of its ends rotatably mounted to the winding frame 1 for rotation of the guide rod 7 about an axis 8 which is at a spacing from the axis of the four link frame on which the winding frame 1 is mounted.

Figure 2:
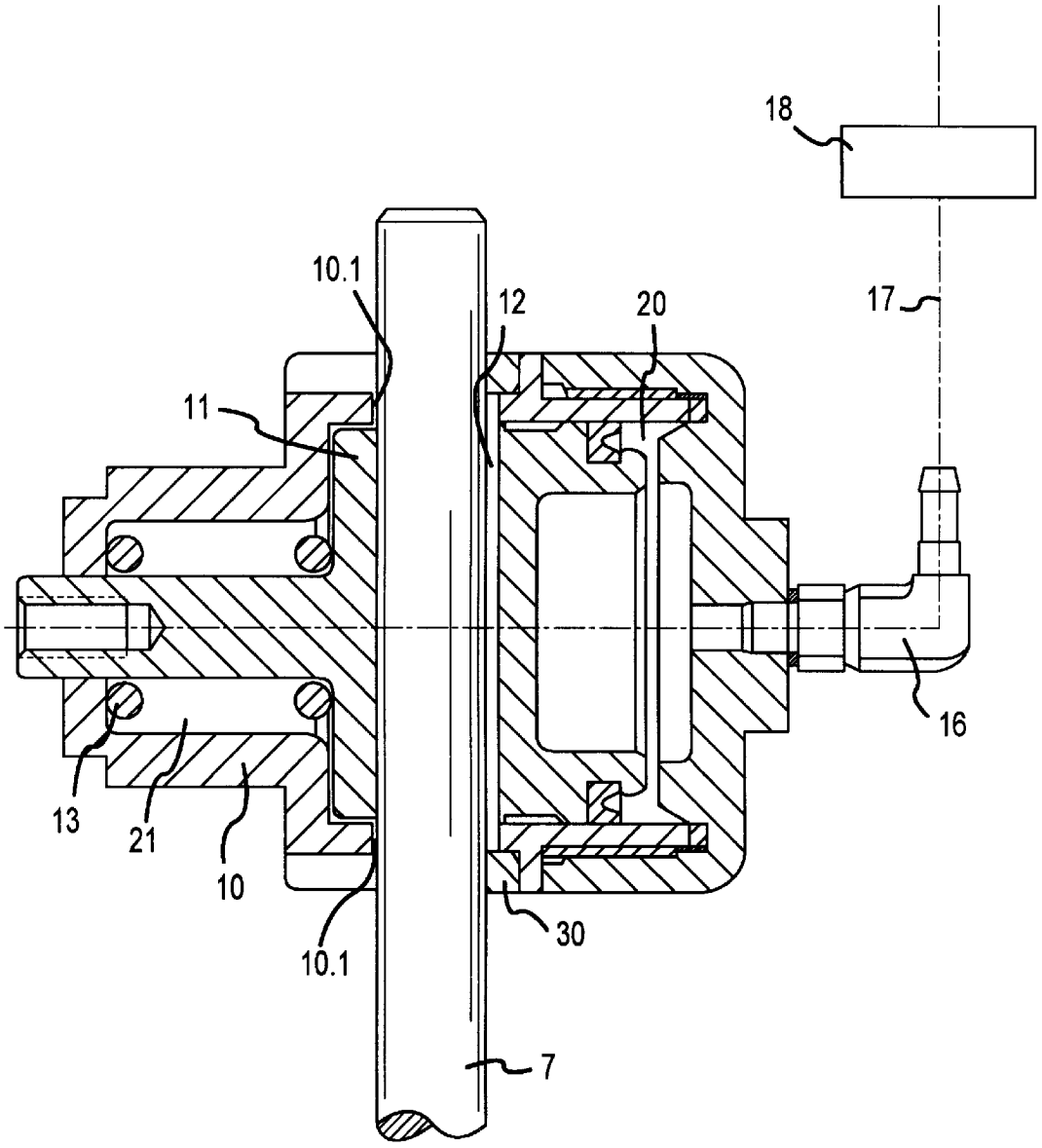
FIG. 2 is an enlarged sectional view of a portion of the damping apparatus.
Figure 3:
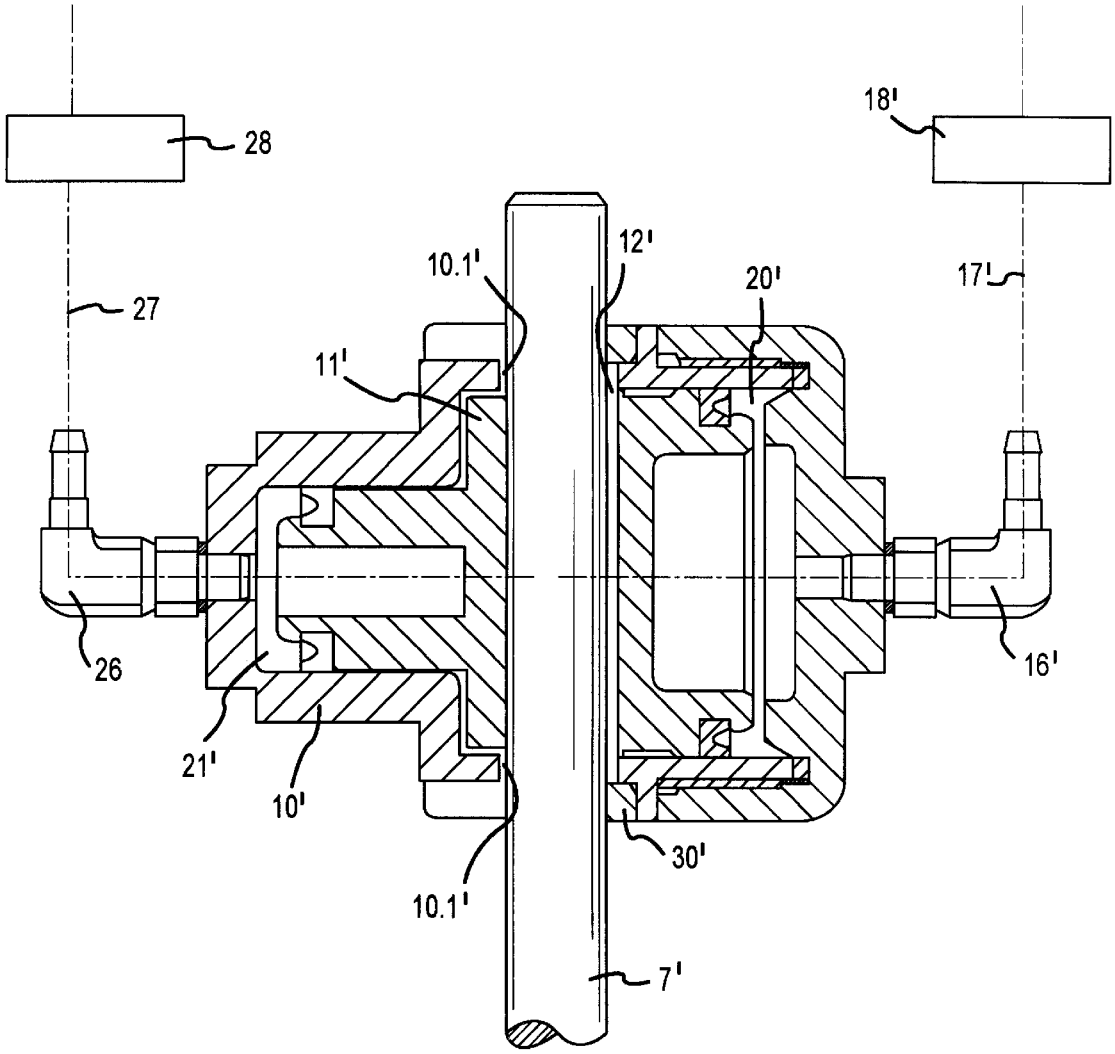
FIG. 3 is a view of a modified form of the damping apparatus shown in FIG. 2.

A cylinder housing 10 or 10', shown in detail in FIGS. 2 and 3, respectively, is pivotably or swingably mounted to a mounting arm 9 secured to the console or the machine frame 32 This cylinder housing 10 or 10' includes a step recess which forms a first cylinder chamber 20 or 20', respectively, and another cylinder chamber 21 or 21', respectively, communicated therewith. The cylinder housing 10 or 10' is, furthermore, provided in the region of the cylinder chamber 20 or 20'. respectively, with diametrically opposed elongate openings 10.1 or 10.1', respectively, through which the guide rod 7 or 7', respectively, is extended.

A piston 11 or 11', respectively, is movably mounted in each housing 10 or 10', respectively, each of which comprises a borehole 12 or 12', respectively, extending perpendicular to the piston axis for receiving therethrough the guide rod 7 or 7', respectively.

In the embodiment of the damping apparatus shown in FIG. 2, a loading spring 13 exerts a force on the left hand side of the piston 11, whereby the guide rod 7 is forced against a portion of the borehole 12 which acts in this capacity as a braking surface.

The piston 11, as well as the piston 11', is formed, at least in the area thereof which forms the braking surface, out of plastic, preferably a thermoplastic.

In the modified embodiment of the damping apparatus shown in FIG. 3, the piston 11' is configured as a step piston, the portion of which within the smaller cylinder chamber 21' being impacted by pressurized air communicated into the chamber by a pressurized air connector 26, with the piston being so configured as a step piston so as to operate in a manner similar to the embodiment shown in FIG. 2 in which the borehole 12' is configured as a braking surface for applying a predetermined braking force against the guide rod 7'. A pressure regulator 28 is actuable for controlling the delivery of pressurized air through a pressurized air conduit 27 (shown only schematically) to the pressurized air connector 26 for impact against the portion of the borehole 12' in the smaller cylinder chamber 21' configured as a braking surface, whereby a braking force tailored to the braking need of the guide rod 7 is delivered.

A ring 30 or 30', respectively, preferably formed of thermoplastic, is mounted on the exterior of the housing 10 or 10', respectively, to act as an inner limit of the elongate opening 10.1 or 10.1', respectively, by forming thereat a counter force body against which the guide rod 7 or 7', respectively, is moved upon the application of force on the guide rod by the braking surface.

As needed, a release of the braking force application by the braking surface can be effected in the embodiments shown in both FIGS. 2 and 3 by the application of pressurized air against the respective section or portion of the piston within the larger cylinder chamber 20 or 20', respectively, the pressurized air being delivered through a pressurized air connector 16 or 16', respectively, and the application of the pressurized air being actuated by controllable valve unit 18 or 18, respectively, connected to a pressurized air conduit 17 or 17', respectively, (shown only schematically) communicated with the pressurized air connector 16 or 16'. This permits the release of the piston 11 or 11', respectively, and, thereby, permits the manual hand damping of the winding frame or, respectively, the release of the piston in the event of an automatic raising of the winding frame such as, for example, by the occurrence of a yarn break.

The application of pressurized air against the portion of the piston within the larger cylinder chamber 20 or 20', respectively, acts to counter the braking force being applied on the guide rod 7 or 7', respectively, in order to thereby release the guide rod 7 or 7', respectively, if the winding frame is to be raised for, for example, the purpose of performing maintenance.

The specification incorporates by reference the disclosure of German priority document 199 24 390.5 of May. 27, 1999.

The present invention is, of course, in no way restricted to the specific disclosure of the specification and drawings, but also encompasses any modifications within the scope of the appended claims.

What I claim is:

1. A winding frame swingably mounted on a machine frame and operable to support a rotatably driveable winding core for the winding of a filament thereon, the winding frame comprising:

a linkage for mounting the winding frame to the machine frame for swinging movement of the winding frame relative to the machine frame in a first swinging direction and a second swinging direction opposite to the first swinging direction; and a damping apparatus for opposing unscheduled swing movements of the winding frame during regular winding of a filament onto the winding core, the damping apparatus having:

a housing pivotally mounted on the machine frame for pivoting about a housing mounting axis;

a guide rod having one end pivotally secured to the winding frame, the guide rod extending through the housing in a disposition permitting movement of the guide rod relative to the housing, a piston having a braking surface thereon, the piston being disposed in the housing;

a cylinder disposed in the housing, the piston being movably mounted in the cylinder for adjustable movement of the piston in a direction perpendicular to the axis of the guide rod so as to selectively bring the braking surface into contact with the guide rod to thereby resist the movement of the guide rod relative to the housing and out of contact with the guide rod to thereby permit movement of the guide rod relative to the housing, and the guide rod, the housing, the winding frame, and the machine frame being arranged relative to one another such that, during the swinging movement of the winding frame relative to the machine frame, the spacing of the housing mounting axis and the machine frame from one another does not vary while the spacing of the one end of the guide rod pivotally secured to the winding frame and the housing mounting axis from one another varies and, during the swinging movement of the winding frame relative to the machine frame, the housing guides the guide rod therethrough.

2. A winding frame swingably mounted on a machine frame and operable to support a rotatably driveable winding core for the winding of a filament thereon, comprising a damping apparatus for opposing unscheduled swing movements of the winding frame during regular winding of a filament onto the winding core and having a guide rod pivotally secured to the winding frame and extending through a housing pivotally mounted on the machine frame, to which guide rod a braking surface is associated forming a portion of a piston disposed in a cylinder, which piston is adjustably movable in a direction perpendicular to the axis of the guide rod.

3. A winding frame according to claim 2 wherein the braking surface is biased into its braking position by a spring acting on the piston.

4. A winding frame according to claim 2 wherein the piston is pneumatically actuable.

5. A winding frame according to claim 2 wherein the piston includes a borehole whose diameter is greater than the outer diameter of the guide rod and the guide rod extends through the borehole.

6. A winding frame according to claim 5 wherein the housing is a cylinder housing in which the piston is disposed, the cylinder housing having a wall with elongate openings formed therein and the borehole being disposed oppositely to the elongate openings.

7. A winding frame according to claim 6 and further comprising a piston surface disposed in the housing for displacing the guide rod from its braked disposition in response to a pulse of pressurized air applied to the piston surface.

8. A winding frame according to claim 7 wherein the cylinder housing includes a step recess forming a pair of mutually communicated cylinder chambers of different diameters.

9. A winding frame according to claim 8 wherein the piston is formed as a step piston whose smaller diameter piston portion acts as an actuation element for actuating the braking surface into its braking disposition against the guide rod and whose larger diameter piston portion acts as the piston surface for displacing the guide rod from its braked disposition in response to a pulse of pressurized air.

10. A winding frame according to claim 2 wherein the guide rod is formed of metal.

11. A winding frame according to claim 10 wherein the guide rod is formed of chromium nickel steel.

12. A winding frame according to claim 2 wherein the one braking surface is formed of thermoplastic.

13. A winding frame according to claim 2 and further comprising a counter element formed of thermoplastic against which the guide rod is movable upon application of the one braking surface there against.

* * * * *